United States Patent [19]

Crosby

[11] 4,363,427

[45] Dec. 14, 1982

[54] ASPHALT DISPENSER VEHICLE

[75] Inventor: Gaius P. Crosby, Mesa, Ariz.

[73] Assignee: Crafco, Inc., Chandler, Ariz.

[21] Appl. No.: 157,040

[22] Filed: Jun. 6, 1980

[51] Int. Cl.[3] ..... B67D 5/62

[52] U.S. Cl. ..... 222/146 H; 222/626

[58] Field of Search ..... 180/321, 332, 333; 404/84; 222/146 H, 626, 627

[56] References Cited

U.S. PATENT DOCUMENTS

| | | | |
|---|---|---|---|
| 2,506,911 | 5/1950 | Zeigler | 222/627 X |
| 2,745,506 | 5/1956 | McCallum | 180/321 |
| 4,085,812 | 4/1978 | Robinson et al. | 180/333 X |
| 4,098,433 | 7/1978 | Oligschlaeger | 222/627 X |
| 4,196,827 | 4/1980 | Leafdale | 222/146 H |

FOREIGN PATENT DOCUMENTS

| | | | |
|---|---|---|---|
| 141846 | 11/1978 | German Democratic Rep. | 222/146 H |
| 1017224 | 1/1966 | United Kingdom | 222/627 |

OTHER PUBLICATIONS

Iowa Manufacturing Co.; "Cedarapids Bituminous Pavers"; Bulletin PAV-2; Dec. 16, 1963.

*Primary Examiner*—David A. Scherbel

*Attorney, Agent, or Firm*—Herbert E. Haynes, Jr.

[57] ABSTRACT

A specialized vehicle for movement along a path parallel to a plurality of containers for dispensing molten asphalt from the vehicle into the containers. The vehicle is configured to physically locate the operator and the controls at the rear corner of the vehicle so that the operator can readily oversee and control movement of the vehicle and the asphalt dispensing operations.

10 Claims, 3 Drawing Figures

ASPHALT DISPENSER VEHICLE

BACKGROUND OF THE INVENTION

1. Field of the Invention

This invention relates to specialized vehicles and more particularly to a special vehicle for dispensing molten asphalt into containers. 2. Description of the Prior Art As is well known in the art molten asphalt is employed for various jobs in the construction arts such as for seal coating roadways, runways and the like, and also for comparatively small jobs such as the filling of cracks and expansion joints in paved surfaces, and various spot applications such as on paved surfaces, roofs, and the like.

In the relatively large jobs, such as the above mentioned seal coating of paved surfaces, where large quantities of molten asphalt are to be used, the molten asphalt is placed in special transport trucks at the asphalt plant and delivered directly to the job site where it is transferred either to interim storage tanks or directly to heated spray applicator trucks. In some instances, the molten asphalt is mixed at the job site with special additives such as shredded rubber, prior to being applied to the paved surface. At any rate, such a procedure must be accomplished rather rapidly to prevent excessive cooling of the molten asphalt, to keep the needed interim storage facilities to a minimum, and to keep the equipment and labor costs to a minimum. Even when this procedure is most efficiently accomplished, it is an expensive matter and as such cannot be economically justified on the comparatively smaller jobs due to the smaller quantities of material needed, the slow and often interrupted application schedules and the like.

Therefore, it is a common practice to place molten asphalt, or molten asphalt compositions, in manually handleable containers at a manufacturing facility and ship the desired quantity to a job site on an as needed and when needed basis. When the asphalt is needed at a job site, the containers are torn open and the asphalt, which has since cooled and thus, solidified, is placed in a heating vessel which is usually a tank that is an integral part of the mechanism which is to be used to apply the asphalt. When the desired temperature of the molten asphalt is reached, normally a minimum of about 275° F., it is applied in accordance with procedures suitable for the particular job.

The commonly used prior art method for placing the asphalt into manually handleable containers is in the form of an elongated conveyor system. At a first station of the prior art conveyor system, a plastic package or liner is inserted into an open corrugated cardboard box and transported by the conveyor to a second station below the outlet of a stationary molten asphalt dispensing unit. At this second station, the dispensing mechanism deposits a predetermined amount of the molten asphalt, usually about sixty pounds, in each container which is passed thereunder. After such filling, the containers are transported to a third station on the conveyor system where the asphalt filled packages and their containers are closed, and from there they are transported to the last station where they are manually off-loaded from the conveyor system and placed on pallets for subsequent shipping.

The prior art method described above has several drawbacks. In the first place, the off-loading and stacking tasks must be accomplished without excessive delays so as not to halt production. Therefore, the asphalt in the containers is still in the molten state when the off-loading and pallet stacking operations need to be accomplished. The molten state of the asphalt rules out the use of all but the most sophisticated mechanized equipment, and the costs of such equipment cannot be justified in operations of this sort. Therefore, the asphalt containers are manually off-loaded and stacked on the pallet, and this is a very arduous and uncomfortable job due to the weight of the asphalt containers and the heat radiating therefrom.

The second, and most serious, problem with the prior art conveyor system for containerizing asphalt involves the lack of portability of the equipment. High shipping costs dictate that a prior art conveyor system cannot be economically used to containerize asphalt for use outside of a given area. Thus, a prior art conveyor system is intermittently used in that it is normally capable of satisfying the needs of its immediate area with, for example, two days of operation per week. Providing containerized asphalt for areas outside of the immediate vicinity of an existing prior art conveyor system involves either paying the high shipping costs, or building and manning other conveyor systems which will also be intermittently operated.

The above described drawbacks and shortcomings of the commonly used prior art asphalt containerization system have been overcome to a great extent by a new method which is fully disclosed in a pending U.S. Patent Application entitled: METHOD FOR CONTAINERIZING ASPHALT, Ser. No. 144,301, filed on Apr. 28, 1980 by J. Ronald Robinson, with the application having the same assignee as the present invention.

Briefly, this new method comprises the placement of a first tier of open top containers in side-by-side relationship on each of a plurality of pallets which are arranged in a linearly aligned juxtaposed relationship. Then an asphalt dispenser vehicle is slowly moved in a path which is parallel to the aligned pallets so that an asphalt dispenser hose provided on the vehicle may be moved from container to container for filling purposes. When each container has been filled in this manner and subsequently closed, a second tier of containers is placed on each pallet, and the dispenser vehicle is again moved in the parallel path for filling of the containers of the second tier. When the second tier of containers are filled and closed, the steps of this method are again repeated for a third tier, and if desired, for additional tiers.

In developing and testing the above described method for containerizing asphalt, it was found that the conventional well known asphalt handling vehicles, such as highway transport trucks, spray applicator trucks and the like, could be used provided they had some simple modifications made thereto. However, some of the inherent characteristics of such vehicles are beyond reasonable modification and those characteristics make their use in this application a very slow, awkward and costly operation.

The above described vehicles are very awkward to use due to the fact that the vehicle's operator is located in a cab at the front of the vehicle and the asphalt is being dispensed from a hose at the back of the vehicle. It is very difficult, if not impossible, for the vehicle's operator to see what is going on; he can't tell when it is time for him to move and he can't tell how far he should move. In many vehicles of this type, the controls for the asphalt pump, and other such equipment, are located in the driver's compartment, and thus the operator who can't see what is going on is the one who must control the flow of the asphalt. Further, such vehicles are equipped with two engines, one to move the vehicle and another to run asphalt mixing augers, dispensing pumps, and the other special components provided on this type of vehicle. When used for their intended purposes, such two engine configurations are highly justifiable. However, in this highly specialized application, it is very costly to operate one engine to handle the asphalt dispensing operations and operate a second engine which moves the vehicle a few feet and then idles until several containers are filled, and then moves the vehicle a few more feet.

Therefore, a need exists for a new and useful asphalt dispenser vehicle which is especially designed for use in containerizing molten asphalt.

SUMMARY OF THE INVENTION

In accordance with the present invention, a new and useful asphalt dispenser vehicle is disclosed for the special purpose of dispensing molten asphalt, or molten asphalt compositions, into a plurality of manually handleable containers.

The vehicle has an asphalt containing tank carried on a suitable frame which is provided with the usual drive wheels at the back and steerable wheels at the front. An engine is provided for driving hydraulic pumps, which, in conjunction with suitable hydraulic motors and control devices, provide power for driving the vehicle, operating a materials agitating auger in the tank and operating an asphalt delivery pump at the rear of the vehicle.

With the exception of secondary vehicle functions, all of the major functions of the vehicle are accomplished hydraulically with power supplied by a single power source in the form of an internal combustion engine.

To facilitate accomplishment of the highly specialized usage of this vehicle, the operator is seated at the rear of the vehicle immediately behind one set of the drive wheels and all of the controls for moving and steering the vehicle as well as dispensing the asphalt are located adjacent the driver's seat.

Accordingly, it is an object of the present invention to provide a new and useful asphalt dispenser vehicle.

Another object of the present invention is to provide a new and useful economically operated asphalt dispenser vehicle which is especially designed to facilitate the dispensing of molten asphalt into a plurality of manually handleable containers.

Another object of the present invention is to provide a new and useful asphalt dispenser vehicle which is designed to move slowly along a path beside a specially arranged plurality of containers while molten asphalt is being dispensed from the vehicle into the containers.

Another object of the present invention is to provide a new and useful asphalt dispenser vehicle of the above described character which utilizes a single power source for moving the vehicle and handling the molten asphalt.

Another object of the present invention is to provide a new and useful asphalt dispenser vehicle of the above described character wherein the single power source is an engine which runs hydraulic pumps which in conjunction with hydraulic motors, pumps, and controls, provide for moving the vehicle, agitating the asphalt and delivering the asphalt.

Still another object of the present invention is to provide a new and useful asphalt dispenser vehicle of the above described character where all of the major functions of the vehicle are controlled by an operator who is located at a rear corner of the vehicle where he can see what is required for accomplishing the desired asphalt dispensing operations.

The foregoing and other objects of the present invention, as well as the invention itself, may be more fully understood from the following description when read in conjunction with the accompanying drawings.

DESCRIPTION OF THE PREFERRED EMBODIMENT

Figures 1, 2, 3:
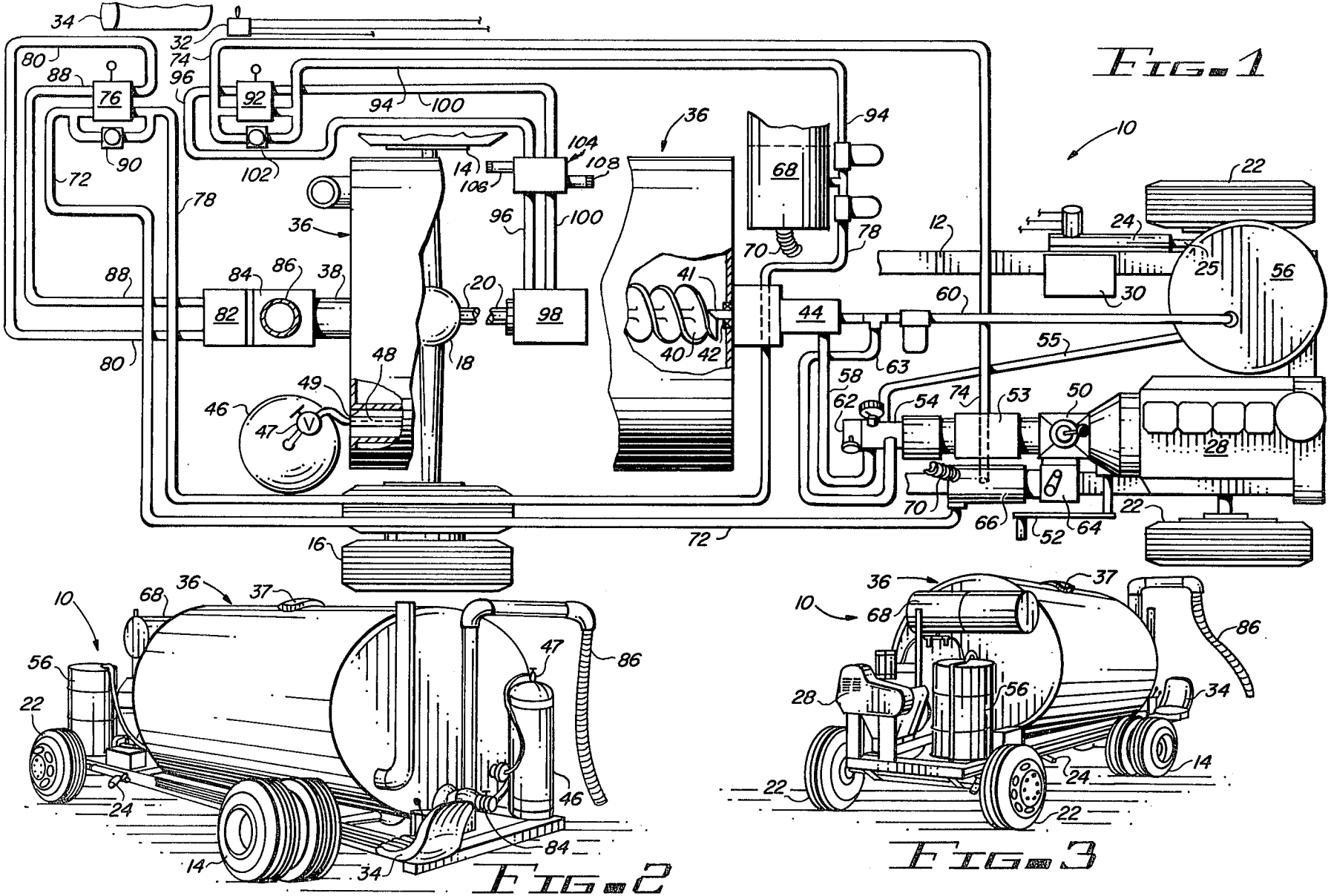
FIG. 1 is a diagrammatic plan view of the asphalt dispenser vehicle of the present invention with portions thereof arranged in schematic form, and other portions broken away to illustrate the various features of the vehicle.
FIG. 2 is a perspective view showing the rear and one side of the vehicle of the present invention.
FIG. 3 is a perspective view showing the front and one side of the vehicle of the present invention.

Referring more particularly to the drawings wherein the asphalt dispenser vehicle of the present invention is indicated in its entirety by the reference numeral 10.

The vehicle 10 includes a suitable frame 12 which is provided with the usual rear wheels 14 and 16 which are driven by a conventional differential 18 which has a power input drive shaft 20. The front wheel 22 of the vehicle are mounted in the usual manner for steering of the vehicle. Due to the unusual remote positioning of the vehicle's operator, as will hereinafter be described, steering cannot be conveniently accomplished in the conventional manner. Therefore, an electrically operated linear actuator 24 is mounted on the vehicle's frame 12 at the left front corner thereof, and its extensible/retractable output shaft 25 is connected to the vehicle's steering linkage (not shown) in the normal manner. Electric power for operation of the linear actuator 24 and for operation of the vehicle's engine 28, is provided by a suitable battery 30 carried on the frame 12 adjacent the actuator. A control switch 32 is provided for selective operation of the linear actuator 24 with the switch being located adjacent the operator's seat 34 at the left rear corner of the vehicle 10.

A large capacity materials tank 36 having a top fill port 37 and an asphalt output port 38 at its rear is mounted on the frame 12 for receiving asphalt from an external source (not shown) and for receiving any additives which may be desirably added thereto, such as shredded rubber. The asphalt received in the tank 36 will be in the molten state and will require agitation to maintain a constant temperature throughout the material and for mixing any additives with the asphalt. Also, agitation is employed to expedite the remelting of residual materials left in the tank from prior uses. The required agitation is preferably accomplished by an auger 40 which is mounted adjacent the bottom of the materials tank so as to extend longitudinally thereof, and the auger has the usual shaft 41 which is rotatably journaled such as in suitable bearings 42 (one shown). One end of the auger shaft 41 extends through the front end of the materials tank for connection to a drive motor 44 as will hereinafter be described.

As is known, comparatively large quantities of molten asphalt will cool at a relatively slow rate when it is contained in a tank of the above described character. However, in some instances, such as upon the occurrence of unexpectedly long delays between asphalt dispensing operations, and the like, it may become necessary to add heat to the molten asphalt in the tank 36 to maintain the proper temperature at which such materials will flow efficiently. Therefore, a fuel tank 46 having the usual controls 47 is mounted on the rear of the vehicle 10 for supplying fuel, such as propane, to a burner 48 which extends into a suitable heating jacket 49 provided in the tank 36.

As seen best in FIG. 1, the engine 28, which is employed to drive a power supply means as will become apparent as this description progresses, is mounted on the right hand front corner of the frame 12 of the vehicle 10 and has a suitable select gear transmission 50 coupled to its power output end through a clutch (not shown) which is selectively engageable by means of a foot operated clutch pedal 52. The transmission 50 is connected through a suitable coupling device 53 for driving a positive displacement hydraulic pump 54 which receives hydraulic fluid through a supply line 55 from a hydraulic fluid reservoir tank 56. The hydraulic pump 54 delivers fluid under pressure through a line 58 to drive the hydraulic motor 44 which is mounted to operate the auger 40 as hereinbefore mentioned. A line 60 is connected between the hydraulic motor 44 and the reservoir tank 56 by which the hydraulic fluid is returned to the reservoir tank. The hydraulic pump 54 has a built-in manually adjustable bypass valve 62 by which more or less hydraulic fluid is directed into the line 63 which is connected directly to the fluid return line 60. In this manner, more or less hydraulic fluid under pressure can be directed to the hydraulic motor for variable speed driving of the auger 40, and thus, the bypass valve 62 acts as a speed control.

Due to the nature of the auger 40 and the asphalt materials which are agitated thereby, the transmission 50 is also employed as a speed control for the auger and this is accomplished by selectively employing the desired gear ratio in the transmission to drive the hydraulic pump 54 at various speeds.

This rather sophisticated speed control arrangement for driving of the auger 40 is needed due to the fact that the residual asphalt left in the materials tank 36 from prior vehicle usage will solidify in the vicinity of the auger 40 and this invariably will lock up the auger. Thus, when starting operation of the vehicle, the addition of molten asphalt will slowly remelt the solidified residual asphalt and auger operation is impossible until some remelting has occurred. When a sufficient amount of remelting has occurred, the auger can be broken free and once agitation begins, total remelting will occur rather rapidly due to fluid circulation. The above described speed control system allows driving power to be carefully applied to the auger to break it free without damaging any of the equipment.

The transmission 50 is provided with a power takeoff unit 64 through which rotary power from the engine 28 is coupled to drive another positive displacement hydraulic pump 66. The pump 66 receives hydraulic fluid from a second hydraulic reservoir tank 68 through a fluid supply line 70. The pump 66 is a double pump in that it supplies hydraulic fluid under pressure to a first fluid delivery line 72 and simultaneously to a second fluid delivery line 74.

The first fluid delivery line 72 is routed along the side and back of the vehicle 10 to a control valve 76 which is mounted adjacent the operator's seat 34. The control valve 76 is a three position manually operated 4-way spool valve of the well known type which when it is in the neutral position will direct the hydraulic fluid received from the delivery line 72 to a fluid return line 78 which is connected to return the fluid back to the reservoir tank 68. Thus, in the neutral position of the control valve 76 the fluid will simply circulate without accomplishing any task.

When the control valve 76 is moved from its neutral position to a first operating position, the hydraulic fluid under pressure is directed through a line 80 to drive a hydraulic motor 82 in one direction with the motor being connected to operate an asphalt delivery pump 84 which is mounted on the asphalt output port 38 of the materials tank 36. In this first operating position of the control valve 76, the asphalt delivery pump 84 is operated to extract the molten asphalt from the materials tank 36 and pump the asphalt through its output port into an elongated flexible delivery hose 86 for materials dispensing purposes. The hydraulic fluid is returned from the motor 82 through a line 88 and is directed by the control valve 76 into the fluid return line 78 which returns it to the reservoir tank 68.

A bypass valve 90 is mounted between the first fluid delivery line 72 and the fluid return line 78, and the bypass valve 90 is a manually adjustable mechanism which allows more or less fluid to bypass the control valve 76. This allows variable speed operation of the hydraulic motor 82 and thus controls the flow rate of the molten asphalt through the asphalt delivery pump 84.

When the control valve 76 is moved to its second operating position, the incoming hydraulic fluid under pressure is directed through the hydraulic motor 82 in a reverse direction, i.e., the fluid is supplied to the motor through line 88 and returns through line 80. In this second operating position of control valve 76, the hydraulic motor 84 will run in the opposite direction and in turn will operate the pump 84 in the opposite direction. This operating mode is used when the asphalt dispensing operations of the vehicle 10 are terminated, or interrupted for longer than a few minutes, in that when so operated, the molten asphalt will be drawn back from the hose 86 and the delivery pump 84 into the materials tank 36 to prevent cooling and subsequent solidification of the asphalt therein.

The second fluid delivery line 74, from the hydraulic pump 66 is directed along the opposite side of the vehicle 10 to another control valve 92 which is also located adjacent the operator's seat 34 at the lefft rear corner of the vehicle 10. The control valve 92, as was the case with the previously described valve 76, is a three position manually operable 4-way spool valve. In the neutral position of the control valve 92, the hydraulic fluid supplied through the delivery line 74 is directed by the valve into a fluid return line 94 which is connected so as to return the fluid back to the reservoir tank 68, and thus circulate the fluid without accomplishing any task.

In the first operating position of the control valve 92, the hydraulic fluid under pressure is directed from the delivery line 74 to a line 96 which extends from the control valve to a hydraulic motor 98 which is mounted to supply rotational power to the differential 18 of the vehicle 10 via the drive shaft 20. The hydraulic motor 98 will therefore operate to move the vehicle 10 in one direction, and the hydraulic fluid is routed back from the motor 98 through a line 100, through the control valve 92 and into the fluid return line 94.

When the control valve 92 is moved to its second operating position, hydraulic fluid flow from the control valve 92 to the hydraulic motor 98 is reversed. In other words, fluid is supplied to the motor 98 through the line 100 and is returned therefrom through the line 96. This will run the hydraulic motor in the reverse direction and thus cause the vehicle 10 to move in a second, or reverse, direction.

A bypass valve 102 is mounted between the fluid delivery line 74 and the fluid return line 94, and this valve is a manually adjustable device which, by allowing more or less hydraulic fluid to bypass the control valve 92, provides variable speed operation of the hydraulic motor 98 and thus variable speed driving of the vehicle 10.

As shown, both of the fluid lines 96 and 100 which couple the control valve 92 and the vehicle moving hydraulic motor 98 are directed through a dual pilot operated relief valve 104. The purpose for the relief valve 104 is to provide a controllable braking action of the vehicle, and its operation will be more easily understood by describing what would happen in the absence of the relief valve 104.

When the vehicle 10 is being driven, in either direction, movement of the control valve 92 from either of its operating positions to its neutral position will completely close the fluid communication between the hydraulic motor 98 and the control valve 92, and such closing would trap the fluid in the lines and in the motor and cause it to lock up. However, inertia of the moving vehicle 10 will apply a load on the motor attempting to move it against the counteracting force applied by the trapped and immovable hydraulic fluid. In the best case, the vehicle would be brought to an abrupt stop and in the worst case, overpressurization could destroy the equipment.

This braking action is made more controllable by the relief valve 104 which, when the control valve 92 is moved to its neutral position, will allow an adjustably predetermined pressure buildup to occur in the hydraulic motor 98 and the fluid lines 96 and 100, and this pressure buildup is used to brake the vehicle. Any pressure buildup beyond the predetermined value will cause the relief valve 104 to open an amount proportional to the overpressurization and allow circulation of the trapped fluid.

To insure complete understanding of the operation of the relief valve 104, the following operational description is presented. It should be understood that when the vehicle 10 is being driven in either direction, the relief valve 104 is inoperative in that it allows hydraulic fluid flow to and from the hydraulic motor 98 in the above described manner. The relief valve 104 is provided with a first adjustable relief portion 106 and a second adjustable relief portion 108. When the vehicle 10 is being operated in the forward direction and the control valve 92 is moved into its neutral position, vehicle inertia will attempt to operate the hydraulic motor 98 so that it moves the trapped fluid into line 96 and extracts it from the line 100. When the pressure exerted on the fluid in this manner exceeds the predetermined value, the first relief portion 106 opens to provide a fluid communication from the line 100 to the line 96 and thus allow a controlled circulation of the fluid to occur in that direction. When the vehicle 10 is being operated in the reverse direction and the control valve 92 is moved to the neutral position, vehicle inertia will attempt to circulate the fluid in the direction opposite to that described above. In other words, the motor will try to move the trapped fluid from line 96 to line 100. When the pressure builds up beyond the adjustably predetermined point, the second adjustable relief portion 108 will open to provide fluid communication from the line 98 to the line 100 to allow controlled circulation to occur in this opposite direction.

From the above detailed description, it will be seen that the vehicle 10 of the present invention is ideally suited for its intended purpose in that the vehicle is configured to economically accomplish all of the functions and operations needed in the handling and dispensing of molten asphalt. Additionally, by physically locating the operator at the rear corner of the vehicle and by the adjacent placement of the controls, the operator can readily oversee the vehicle's operation and can control all of the functions which need manipulation during asphalt dispensing operations.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles.

For example, the electrically operated linear activator 24 by which the vehicle 10 is steered need not be an electric device, in that a hydraulic ram (not shown) would serve the same purpose. Further, the operator's seat 34 could be mounted on a swivel device to facilitate driving operation of the vehicle in either direction during its asphalt dispensing operations.

The appended claims are therefore intended to cover and embrace any such modifications within the limits only of the true spirit and scope of the invention.

What I claim is:

1. A specialized vehicle for movement in a path alongside a plurality of containers for dispensing liquified molten asphalt from the vehicle into the containers, said vehicle comprising:

(a) a frame having a front and a back;

(b) drive wheels mounted at the back of said frame;

(c) first motor means coupled to said drive wheels for driving thereof;

(d) first control means coupled to said first motor means for variable speed operation thereof in selectively opposite directions;

(e) a materials tank mounted on said frame for receiving liquified molten asphalt;

(f) an asphalt delivery pump connected to said materials tank at the back of said frame for dispensing liquified molten asphalt from said tank;

(g) second motor means coupled to said asphalt delivery pump for operation thereof;

(h) second control means coupled to said second motor means for variable speed operation thereof in selectively opposite directions;

(i) an engine means mounted on said frame;

(j) power supply means driven by said engine for producing power which is coupled through said first and said second control means to operate said first and said second motor means;

(k) an operator's seat located at the back corner of said frame; and (l) said first and said second control means mounted on said frame adjacent said operator's seat.

2. A specialized vehicle as claimed in claim 1 and further comprising:

(a) said power supply means includes a hydraulic pump;

(b) said first motor means is a hydraulic motor coupled to receive hydraulic fluid under pressure from said hydraulic pump; and (c) said first control means is interposed between said hydraulic pump and said hydraulic motor and includes, I. a manually operable 4-way valve having a neutral position wherein the hydraulic fluid is directed so as to completely bypass said hydraulic motor, a first operating position wherein the hydraulic fluid is directed so as to drive said hydraulic motor in one direction and a second operating position wherein the hydraulic fluid is directed so as to drive said hydraulic motor in an opposite direction, and II. a manually adjustable bypass valve for directing a controllable amount of the hydraulic fluid through said 4-way valve to control the driven speed of said hydraulic motor.

3. A specialized vehicle as claimed in claim 2 and further comprising a relief valve interposed between said 4-way valve and said hydraulic motor which operates to allow hydraulic fluid circulation from said hydraulic motor through said relief valve and back to said hydraulic motor upon an increase in hydraulic fluid pressure above an adjustably predetermined value.

4. A specialized vehicle as claimed in claim 1 and further comprising:

(a) said supply means including a hydraulic pump;

(b) said second motor means is a hydraulic motor coupled to receive hydraulic fluid under pressure from said hydraulic pump; and (c) said second control means is interposed between said hydraulic pump and said hydraulic motor and includes, I. a manually operable 4-way valve having a neutral position wherein the hydraulic fluid is directed so as to completely bypass the hydraulic motor, a first operating position wherein the hydraulic fluid is directed so as to drive said hydraulic motor in one direction and a second operating position wherein the hydraulic fluid is directed so as to drive said hydraulic motor in an opposite direction, and II. a manually adjustable bypass valve for directing a controllable amount of the hydraulic fluid through said 4-way valve to control the driven speed of said hydraulic motor.

5. A specialized vehicle as claimed in claim 1 and further comprising:

(a) agitation means mounted in said materials tank for agitation of the liquified molten asphalt received therein;

(b) motor means connected to said agitation means for driving thereof; and (c) said power supply means connected to said motor means for variable speed operation thereof.

6. A specialized vehicle as claimed in claim 5 and further comprising:

(a) said agitation means is an auger extending longitudinally along the bottom of said materials tank and journaled for rotation therein;

(b) said motor means is a hydraulic motor; and (c) said power supply means includes, I. a hydraulic pump for delivering hydraulic fluid under pressure to said hydraulic motor, II. a select gear transmission interposed between said hydraulic pump and said engine for variable speed driving of said hydraulic pump, and III. a manually adjustable bypass valve for directing a controllable amount of the hydraulic fluid under pressure to said hydraulic motor for variable speed driving thereof.

7. A specialized vehicle as claimed in claim 1 and further comprising:

(a) steerable wheels mounted on the front of said frame;

(b) actuator means mounted on the front of said frame and coupled to said steerable wheels for steerable operation thereof; and (c) control means located at the back of said frame adjacent said operator's seat and coupled to said actuator means for actuation thereof.

8. A specialized vehicle as claimed in claim 1 and further comprising:

(a) steerable wheels mounted on the front of said frame;

(b) a linear actuator mounted on the front of said frame and coupled to said steerable wheels, said linear actuator movable between extended and retracted positions thereof for turning said steerable wheels in opposite directions;

(c) a source of power mounted on said frame and coupled to said linear actuator; and (d) a control means located adjacent said operator's seat at the rear of said frame and interposed between said source of power and said linear actuator for selectively operating said linear actuator between its extended and retracted positions.

9. A specialized vehicle as claimed in claim 1 and further comprising means connected to said materials tank for the optional addition of heat to the liquified molten asphalt receivable therein.

10. A specialized vehicle as claimed in claim 1 and further comprising an elongated flexible hose coupled to the output port of said asphalt delivery pump for dispensing the liquified molten asphalt from said materials tank into the containers.

* * * * *